US005863186A

United States Patent [19]

Green et al.

[11] Patent Number: 5,863,186

[45] Date of Patent: Jan. 26, 1999

[54] METHOD FOR COMPRESSING GASES USING A MULTI-STAGE HYDRAULICALLY-DRIVEN COMPRESSOR

[76] Inventors: John S. Green, 36123 Camp Creek Rd., Springfield, Oreg. 97478; Odom H. Odom, 26344 Cory Rd., Junction City, Oreg.

[21] Appl. No.: 729,337

[22] Filed: Oct. 15, 1996

[51] Int. Cl.[6] ..... F04B 25/00

[52] U.S. Cl. ..... 417/53; 417/244; 417/266

[58] Field of Search ..... 417/53, 266, 244

[56] References Cited

U.S. PATENT DOCUMENTS

| | | | |
|---|---|---|---|
| 261,605 | 7/1882 | Hill | 417/248 |
| 2,510,127 | 6/1950 | Mercier | 230/56 |
| 2,581,191 | 1/1952 | Kalitinsky | 230/56 |
| 2,628,015 | 2/1953 | Nuegebauer et al. | 230/56 |
| 3,244,106 | 4/1966 | Guy | 103/5 |
| 4,990,057 | 2/1991 | Rollins | 417/12 |

*Primary Examiner*—Timothy Thorpe
*Assistant Examiner*—Ehud Gartenberg

[57] ABSTRACT

A method of compressing a compressible fluid, using a hydraulically driven compressor comprising a precompressor, a first cylinder, and a second cylinder. The precompressor receives a low pressure input of compressible fluid and fills the first cylinder to a precompressor output target pressure. A piston within the first cylinder then forces the compressible fluid into the second cylinder. This cycle is repeated until the second cylinder is filled to a first-cylinder output target pressure, whereupon a piston within the second cylinder forces the compressible fluid out of the second cylinder as a high pressure compressible fluid output, typically into some sort of storage vessel. This cycle is repeated until the compressible fluid output pressure reaches a second-cylinder output target pressure. Pressure and position sensors may be employed to provide signals to a controller, which in turn provides signals to hydraulic fluid control valves which control operation of the precompressor, the first cylinder, and the second cylinder.

3 Claims, 6 Drawing Sheets

METHOD FOR COMPRESSING GASES USING A MULTI-STAGE HYDRAULICALLY-DRIVEN COMPRESSOR

FIELD OF THE INVENTION

The field of the present invention relates to compressors. In particular, hydraulically driven compressor methods and apparatus are described herein for raising the pressure of a low pressure input source of compressible fluid to a high output pressure. The hydraulically driven compressor methods and apparatus described herein may be used for natural gas storage for natural gas powered motor vehicles.

BACKGROUND

The problem of air pollution generated by the use of automobiles and other motor vehicles is a major global environmental concern. Traditional gasoline burning internal combustion engines produce a great many products of incomplete combustion which are released into the atmosphere at the rate of millions of tons per year and which lead to a host of environmental problems, either themselves or as precursors of other pollutants formed by atmospheric chemical reactions. The search for cleaner alternatives has been extensive and is ongoing.

Motor vehicles which burn natural gas have recently been developed which produce significantly smaller amounts of pollutants. Major impediment to widespread use of such vehicles have been the problems of fuel availability and storage. The availability problem would seem to be easily solvable. Many residential and commercial buildings have a natural gas supply lines for heating and cooking, and tapping into these existing supply lines would seem to pose no great problem. However, the pressure in these supply lines is low, rendering the volume of the amount of natural gas required to power a vehicle over any practically useful distance too large to store and/or carry on board the vehicle.

Compressors are devices for converting a volume of compressible fluid at a given temperature and pressure to a smaller volume having a correspondingly higher pressure but preferably the same temperature. Such devices are useful for storage of gases, which are quite compressible and whose volumes vary inversely with pressure at constant temperature. Therefore a natural solution to the gas storage problem associated with natural gas powered vehicles is compression of the natural gas and storage of the compressed gas at a much higher pressure than is available from typical residential or commercial supply lines.

There are, however, problems associated with use of a compressor in this particular application. A typical compressor is substantially similar in its structure and operation to an internal combustion engine. Pistons for compressing the gas are reciprocated at high speeds within cylinders by piston rods connected to a crankshaft. Such a compressor comprises a large number of moving parts which are subject to large frictional forces, high temperatures, and therefore may wear and/or fail quickly. It has been estimated that a typical compressor used in this application would require a major overhaul and/or replacement on approximately a yearly basis, burdening a vehicle owner with considerable inconvenience and expense. In addition, such compressors are bulky, consume a large amount of power, are noisy, and generate large amounts of heat.

A hydraulically driven compressor is an alternative solution to this particular problem. The only power source required is a hydraulic power supply, which may be driven by an electric motor, runs quietly, and is durable, having fewer moving parts and requiring little maintenance. Higher final pressures may be attained with a hydraulically driven compressor. A hydraulically driven compressor may be driven slowly, significantly ameliorating problems associated with power consumption, friction, heat generation, and wear. In addition, the hydraulic power supply need only be connected to the compressor by supply and return lines for the hydraulic fluid, thereby allowing placement of the power supply far from the compressor itself. When dealing with high pressure combustible fluids such as natural gas, this may be a major safety advantage. Several examples of hydraulically driven compressors can be found in the patent literature, in particular U.S. Pat. Nos.: 4,390,322; 4,761,118; 5,238,372; and 5,464,330, each of which exhibit hydraulically driven pumps or compressors.

Gas liquefaction methods and/or apparatus are described in U.S. Pat. Nos.: 4,172,711; 4,456,459; 4,923,492; 5,473,900; 5,537,827; and 5,385,176.

SUMMARY OF THE INVENTION

Certain aspects of the present invention may overcome aforementioned drawbacks of the previous art and advance the state-of-the-art of hydraulically driven compressors, and in addition may meet one or more of the following objects:

To provide a hydraulically driven compressor for receiving a low pressure compressible fluid input and producing a high pressure compressible fluid output;

To provide a method for receiving a low pressure compressible fluid input and producing a high pressure compressible fluid output using a hydraulically driven compressor;

To provide hydraulically driven compressor methods and apparatus which require low hydraulic power;

To provide hydraulically driven compressor methods and apparatus which may generate large compression ratios;

To provide hydraulically driven compressor methods and apparatus wherein intermediate and final compression ratios may be readily adjusted;

To provide hydraulically driven compressor methods and apparatus wherein heat generated by compression is efficiently dissipated;

To provide hydraulically driven compressor methods and apparatus which may operate at low reciprocation speeds and low repetition rates;

To provide a hydraulically driven compressor which is robust and requires little maintenance;

To provide a hydraulically driven compressor which operates quietly; and

To provide hydraulically driven compressor methods and apparatus for compressing low pressure natural gas from a commercial or residential gas line to a high pressure in a vehicle or storage vessel.

One or more of these objects may be achieved in the present invention by a hydraulically driven compressor. A preferred embodiment of a hydraulically driven compressor according to the present invention comprises a precompressor, a first cylinder, and a second cylinder. The precompressor receives a low pressure input of compressible fluid (from a commercial or residential gas line, for example) and fills the first cylinder to a precompressor output target pressure. A piston within the first cylinder then forces the compressible fluid into the second cylinder. This cycle is repeated until the second cylinder is filled to a first-cylinder output target pressure, whereupon a piston within the second cylinder forces the compressible fluid out of the second cylinder as a high pressure compressible fluid output, typically into some sort of tank or storage vessel. This cycle is repeated until the compressible fluid output pressure reaches a second-cylinder output target pressure. Pressure and position sensors may be employed to provide signals to a controller, which in turn provides signals to hydraulic fluid control valves which control operation of the precompressor, the first cylinder, and the second cylinder.

Additional objects and advantages of the present invention may become apparent upon referring to the preferred and alternative embodiments of the present invention as illustrated in the drawings and described in the following written description.

DETAILED DESCRIPTION OF PREFERRED AND ALTERNATIVE EMBODIMENTS

Figure 1:
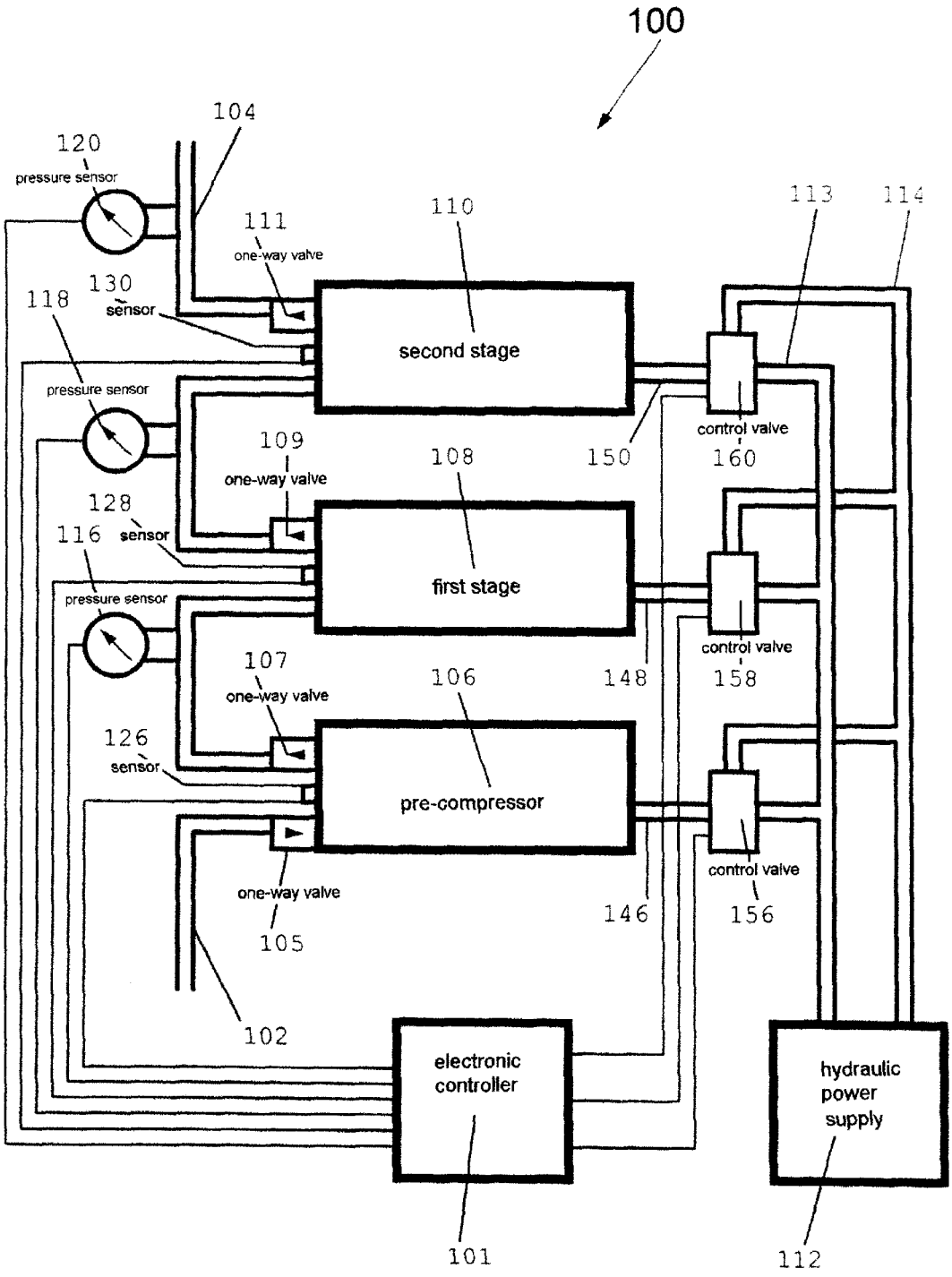
FIG. 1 is a schematic diagram of a hydraulically driven compressor comprising a precompressor, a first cylinder, and a second cylinder according to the present invention.

FIG. 1 is a schematic diagram of a preferred embodiment of a hydraulically driven compressor 100 according to the present invention, comprising a precompressor 106, and first cylinder 108, and a second cylinder 110. Precompressor 106 is connected to a low pressure compressible fluid compressor input through one-way valve 105, first cylinder 108 is connected to precompressor 106 through one-way valve 107, second cylinder 110 is connected to first cylinder 108 through one-way valve 109, and high pressure compressor output passes out of second cylinder 110 through one-way valve 111. Each of precompressor 106, first cylinder 108, and second cylinder 110 is provided with output pressure sensors 116, 118, and 120, respectively, with position sensors 126, 128, and 130, respectively, with hydraulic supply/return lines 146, 148, and 150, respectively, and with hydraulic fluid control valves 156, 158, and 160, respectively. High pressure hydraulic fluid is supplied to the hydraulic fluid control valves 156, 158, and 160 by a hydraulic power supply 112 via hydraulic supply line 113, and hydraulic fluid returns from control valves 156, 158, and 160 to hydraulic power supply 112 via hydraulic return line 114. Signals from position sensors 126, 128, and 130 and pressure sensors 116, 118, and 120 are provided to a controller 101, which in turn provides signals controlling hydraulic fluid control valves 156, 158, and 160.

A low pressure compressible fluid compressor input (from a commercial or residential natural gas line, for example) enters through fluid input line 102 and one-way valve 105 into precompressor 106. Flow of high pressure hydraulic fluid from hydraulic supply line 113 to precompressor 106 and from precompressor 106 to hydraulic return line 114 through control valve 156 operates precompressor 106 to fill first cylinder 108 through one-way valve 107 until the pressure measured by pressure sensor 116 reaches a precompressor output target pressure. If not already above the precompressor output target pressure, second cylinder 110 is also filled through one-way valve 109 by operation of precompressor 106. During operation of precompressor 106, hydraulic fluid may flow from first cylinder 108 through control valve 158 to hydraulic return line 114 and from second cylinder 110 through control valve 160 to hydraulic return line 114. Once the precompressor output target pressure has been reached, controller 101 deactivates precompressor 106 by switching control valve 156 thereby blocking flow of high pressure hydraulic fluid from hydraulic supply line 113 to precompressor 106, and activates first cylinder 108 by switching control valve 158 thereby allowing flow of high pressure hydraulic fluid from hydraulic supply line 113 into first cylinder 108 and blocking return of hydraulic fluid from first cylinder 108 to hydraulic return line 114. Activation of first cylinder 108 results in compressible fluid flow from first cylinder 108 through one-way valve 109 into second cylinder 110. After first cylinder 108 completes its compression, controller 101 switches control valve 158 thereby blocking flow of high pressure hydraulic fluid from hydraulic supply line 113 into first cylinder 108 and allowing return of hydraulic fluid from first cylinder 108 to hydraulic supply line 114, and reactivates precompressor 106 by switching control valve 156 thereby allowing flow of high pressure hydraulic fluid from hydraulic supply line 113 to precompressor 106.

The precompression cycle described in the preceding paragraph is repeated until the pressure measured by pressure sensor 118 reaches a first-cylinder output target pressure. During the precompression cycle hydraulic fluid may return through control valve 160 to hydraulic return line 114. Once the first-cylinder output target pressure has been reached, controller 101 deactivates precompressor 106 by switching control valve 156 thereby blocking flow of high pressure hydraulic fluid from hydraulic supply line 113 to precompressor 106, deactivates first cylinder 108 by switching control valve 158 thereby blocking flow of high pressure hydraulic fluid from hydraulic supply line 113 to first cylinder 108 and allowing return of hydraulic fluid from first cylinder 108 to hydraulic return line 114, and activates second cylinder 110 by switching control valve 160 thereby blocking return of hydraulic fluid from second cylinder 110 to hydraulic return line 114 and allowing flow of high pressure hydraulic fluid from hydraulic supply line 113 into second cylinder 110. Activation of second cylinder 110 results in compressible fluid flow from second cylinder 110 through one-way valve 111 as a high pressure compressible fluid compressor output. The high pressure output may flow into a tank or storage vessel (not shown). After second cylinder 110 completes its compression, controller 101 switches control valve 160 thereby blocking flow of high pressure hydraulic fluid from hydraulic supply line 113 into second cylinder 110 and allowing return of hydraulic fluid from second cylinder 110 to hydraulic return line 114, and reactivates precompressor 106 by switching control valve 156 thereby allowing flow of high pressure hydraulic fluid from hydraulic supply line 113 to precompressor 106.

The compression cycle described in the preceding paragraph is repeated until the pressure measured by pressure sensor 120 reaches a second-cylinder output target pressure.

Upon reaching the second-cylinder output target pressure, controller 101 switches control valves 156, 158, and 160, thereby blocking flow of high pressure hydraulic fluid from hydraulic supply line 113 to precompressor 106, first cylinder 108, and second cylinder 110 thereby deactivating precompressor 106, first cylinder 108, and second cylinder 110.

For purposes of this specification including the claims set forth hereinafter, and without departing from inventive concepts disclosed and/or claimed herein, the term "free floating piston" shall denote a piston reciprocatably and substantially sealedly positioned within a cylinder thereby dividing said cylinder into separate chambers, but not necessarily having a mechanical connection to said cylinder or to any other component of the compressor apparatus (including a rod or shaft). For purposes of this specification including the claims set forth hereinafter, and without departing from inventive concepts disclosed and/or claimed herein, the term cylinder shall denote any chamber which may be divided into separate chambers by a piston (free floating or otherwise) and within which said piston may substantially sealedly reciprocate, regardless of the exact shape or dimensions of said cylinder. In particular, a cylinder as recited in this specification including the claims set forth hereinafter need not be cylindrical.

Figure 2:
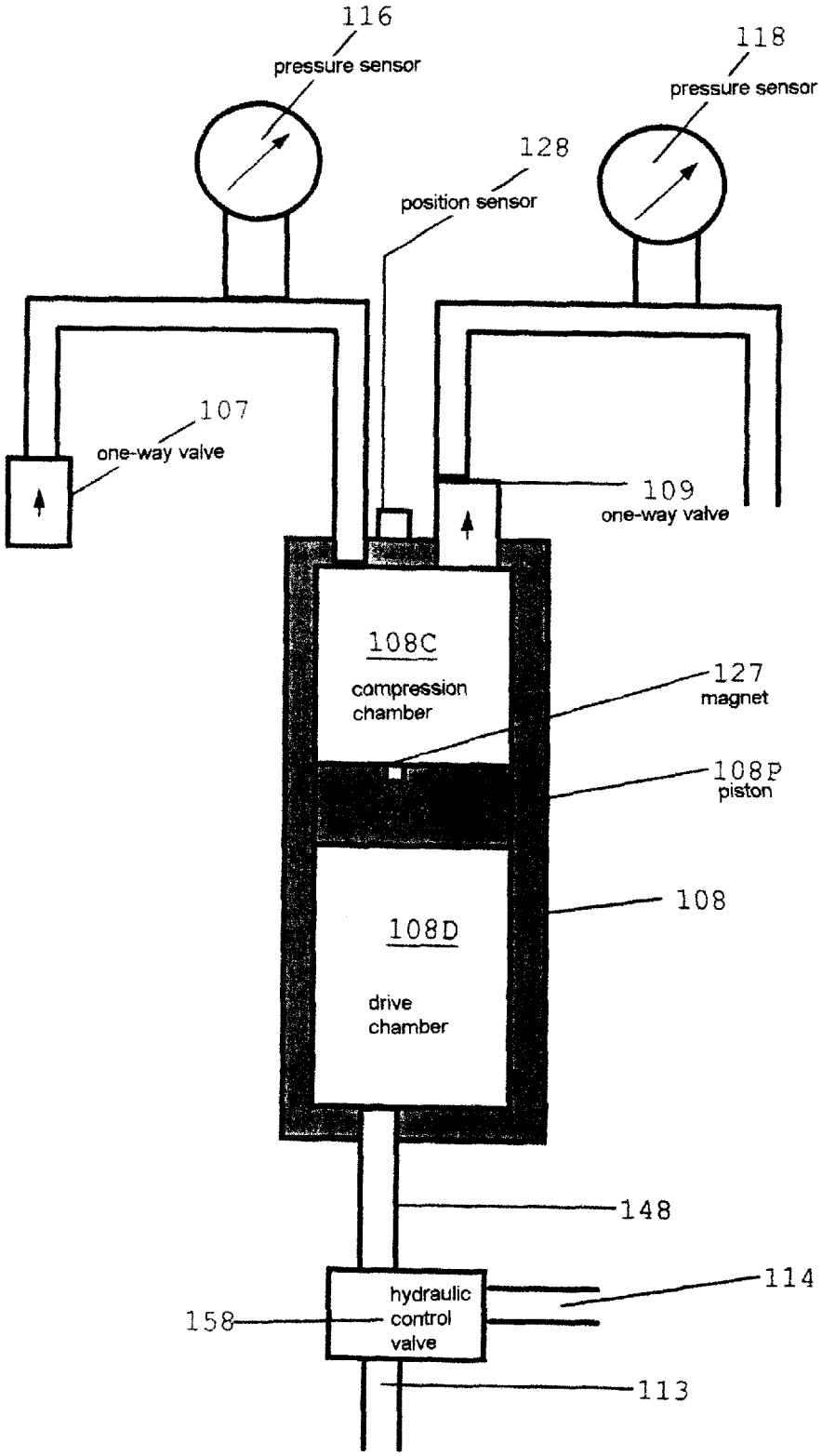
FIG. 2 is a cross sectional view of a first cylinder of a hydraulically driven compressor according to the present invention.
Figure 3:
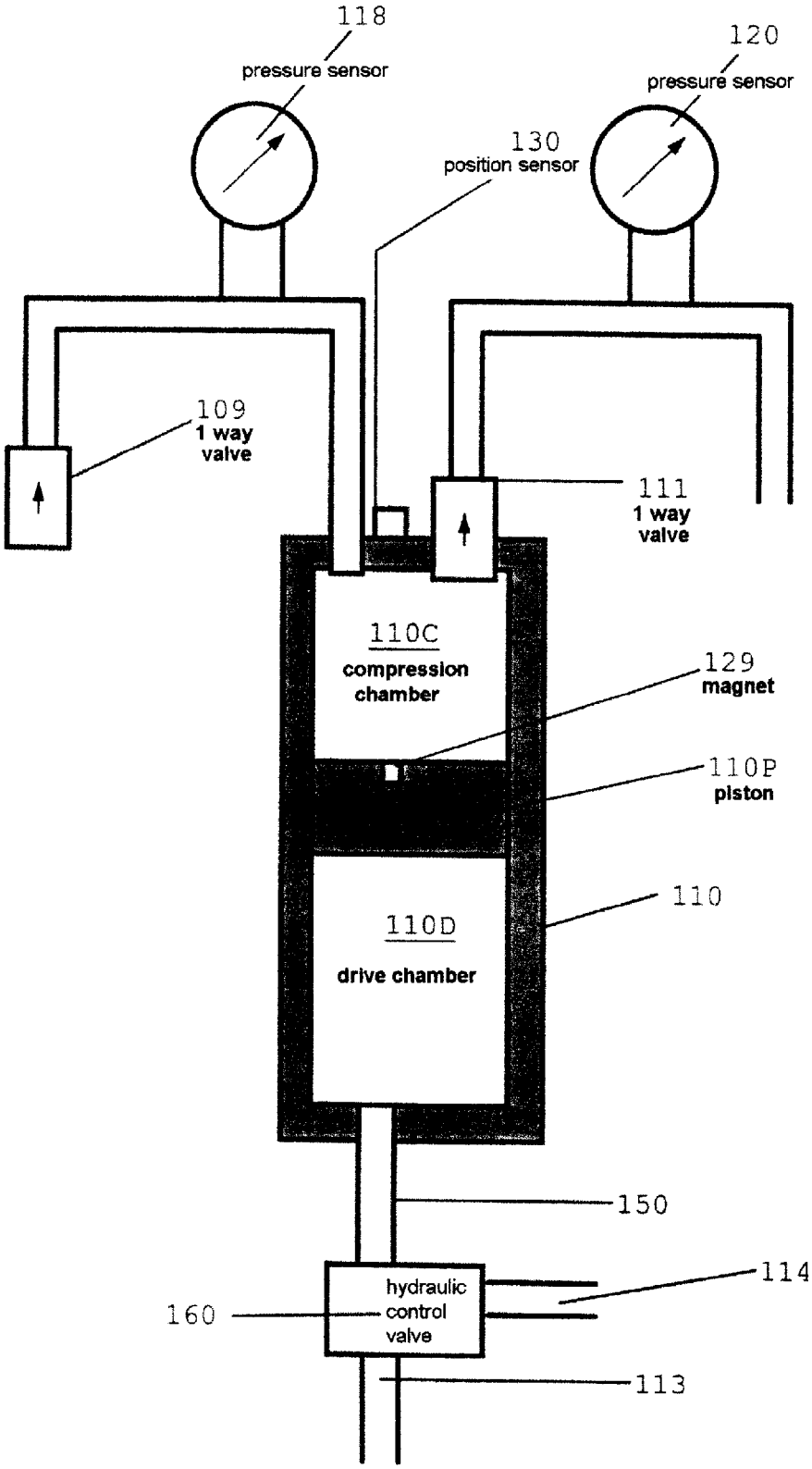
FIG. 3 is a cross sectional view of a second cylinder of a hydraulically driven compressor according to the present invention.

The structure and operation of precompressor 106, first cylinder 108, and second cylinder 110 will now be described in more detail. Cylinders 108 and 110 each comprise an elongated cylinder as shown in FIGS. 2 and 3, respectively. A free floating piston 108P is substantially sealedly and reciprocatably positioned within cylinder 108, thereby dividing cylinder 108 into a compression chamber 108C and a drive chamber 108D. In a preferred embodiment of the present invention, cylinder 108 is about 30 inches long and about 4 inches in diameter, and piston 108P is about 4 inches long and has no mechanical connection to cylinder 108 or any other component of the compressor. Without departing from inventive concepts disclosed and/or claimed herein, any cylinder diameter and/or length and any piston length may be employed provided that the piston may be substantially sealedly and reciprocatably positioned within the cylinder. In an alternative embodiment of the present invention, the length of piston 108P is larger than half the length of cylinder 108, thereby reducing the risk of contamination of the compressible fluid by the hydraulic fluid. Piston 108P may be provided with one or more piston rings (not shown) for substantially sealedly and reciprocatably engaging the interior of cylinder 108. In a preferred embodiment of the present invention the piston rings may be fabricated from a substantially rigid graphite impregnated polymeric material. Without departing from inventive concepts disclosed and/or claimed herein, any suitable functionally equivalent material may be employed for fabricating the piston rings. Piston 108P may be provided with one or more wiper rings (not shown) for substantially sealedly and reciprocatably engaging the interior of cylinder 108. In a preferred embodiment of the present invention the wiper rings may be fabricated from a resilient polymeric material. Without departing from inventive concepts disclosed and/or claimed herein, any suitable functionally equivalent material may be employed for fabricating the wiper rings. During operation of cylinder 108, the pressure of the compressible fluid in compression chamber 108C is larger than or substantially equal to the pressure of the hydraulic fluid in drive chamber 108D (since the areas of the drive chamber and compression chamber are substantially the same), thereby reducing the likelihood of flow of hydraulic fluid from drive chamber 108D around piston 108P into compression chamber 108C and contamination of the compressible fluid.

A signal from controller 101 switches control valve 158 so that hydraulic fluid may return from drive chamber 108D through control valve 158 to hydraulic return line 114. As compressible fluid flows through one-way valve 107 into compression chamber 108C, piston 108P moves in a first direction within cylinder 108, thereby increasing the volume of compression chamber 108C, decreasing the volume of drive chamber 108D, and forcing return of hydraulic fluid through control valve 158 to hydraulic return line 114. Once piston 108P reaches the end of its motion in the first direction, further flow of compressible fluid through one-way valve 107 into compression chamber 108C results in increasing pressure measured by pressure sensor 116.

The signal from pressure sensor 116 is provided to controller 101, and when the pressure measured by sensor 116 reaches a precompressor output target pressure (also referred to as the first-cylinder input target pressure), signals are generated by controller 101 which: terminate flow of compressible fluid through one-way valve 107 into compression chamber 108C by deactivating precompressor 106; and switch control valve 158 thereby blocking flow of hydraulic fluid from drive chamber 108D to hydraulic return line 114 and allowing flow of high pressure hydraulic fluid from hydraulic supply line 113 into drive chamber 108D, thereby increasing the volume of drive chamber 108D, moving piston 108P in a second direction, decreasing the volume of compression chamber 108C, and forcing flow of compressible fluid out of compression chamber 108C through one-way valve 109. When piston 108P reaches the end of cylinder 108 in the second direction, magnet 127 on piston 108P is brought near position sensor 128 in cylinder 108. In a preferred embodiment of the present invention, position sensor 128 comprises a magnetic reed switch for detecting when piston 108P has completed its motion in the second direction. The signal from position sensor 128 is provided to controller 101, which in turn provides signals which: switch control valve 158 thereby blocking flow of high pressure hydraulic fluid from hydraulic supply line 113 into drive chamber 108D and allowing return of hydraulic fluid from drive chamber 108D to hydraulic return line 114; and resume flow of compressible fluid through one-way valve 107 into compression chamber 108C by activation of precompressor 106.

The structure and function of second cylinder 110 is completely analogous to that of first cylinder 108 described in the preceding paragraphs. Free floating piston 110P is substantially sealedly and reciprocatably positioned within second cylinder 110 with no mechanical connection to second cylinder 110 or to any other compressor component, and divides second cylinder 110 into compression chamber 110C and drive chamber 11OD. Compressible fluid enters through one-way valve 109 and exits through one-way valve 111. Hydraulic fluid control valve 160 controls flow of hydraulic fluid to and from drive chamber 110D in response to signals generated by controller 101 in response to signals from pressure sensors 118 and 120 and from position sensor 130 and magnet 129. Piston 110P may include at least one piston ring and/or at least one wiper ring as described hereinabove.

Figure 4:
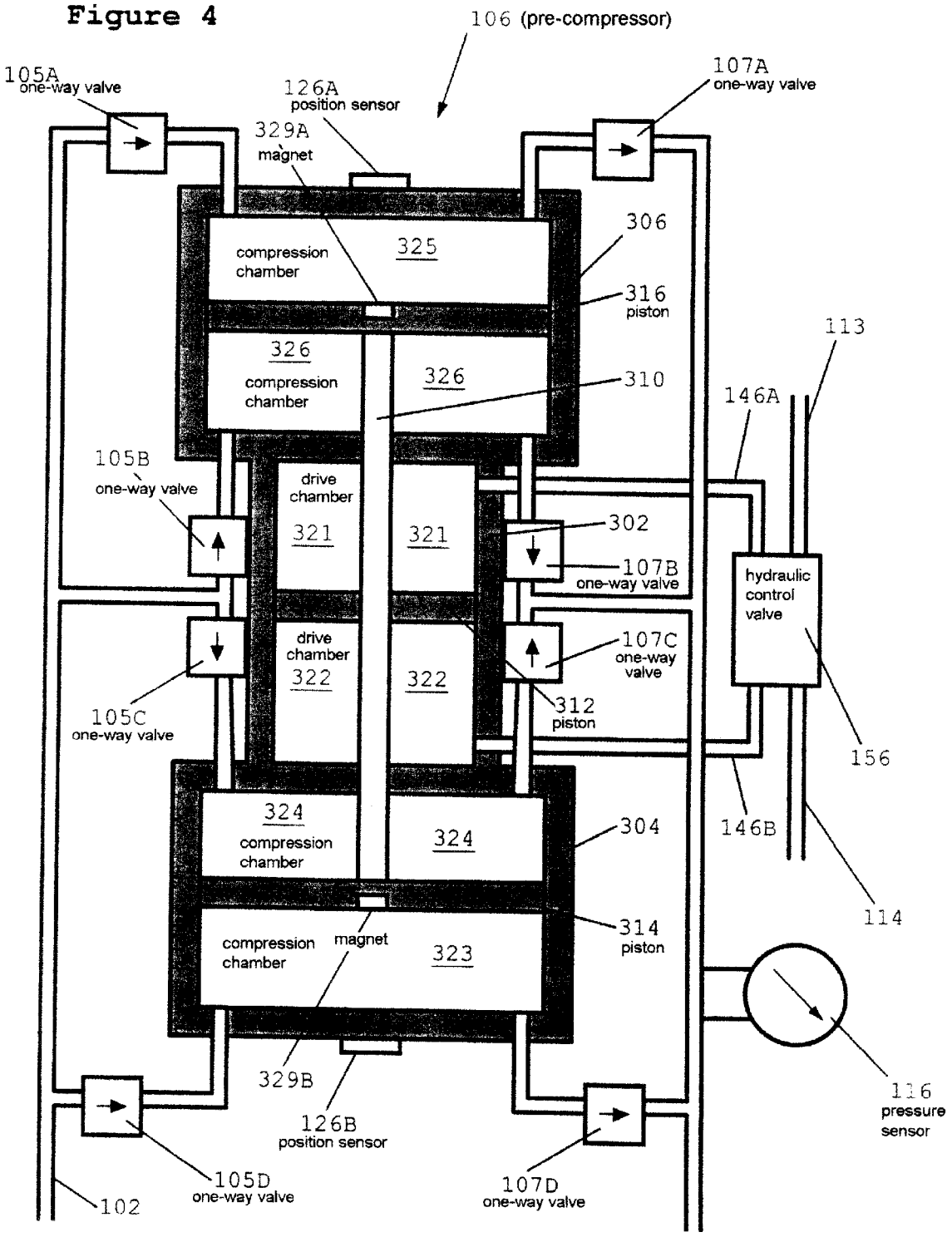
FIG. 4 is a cross sectional view of a hydraulically driven precompressor of a hydraulically driven compressor according to the present invention.

In a preferred embodiment of a compressor according to the present invention, precompressor 106 comprises a three cylinder/ three piston assembly as illustrated in FIG. 4. A center cylinder 302 is positioned coaxially between two larger diameter end cylinders 304 and 306. A rod 310 extends from end cylinder 304 through center cylinder 302 and into end cylinder 306. Rod 310 is substantially sealedly and reciprocatably positioned within axial holes within bulkheads separating center cylinder 302 from end cylinders 304 and 306. A center piston 312 is secured to rod 310 and substantially sealedly and reciprocatably positioned within center cylinder 302, thereby dividing center cylinder 302 into drive chambers 321 and 322. End piston 314 is secured to one end of rod 310 and substantially sealedly and reciprocatably positioned within end cylinder 304, thereby dividing end cylinder 304 into compression chambers 323 and 324. End piston 316 is secured to the other end of rod 310 and substantially sealedly and reciprocatably positioned within end cylinder 306, thereby dividing end cylinder 306 into compression chambers 325 and 326. One-way valve 105 (shown as a single valve in FIG. 1) comprises four separate one-way valves 105A, 105B, 105C and 105D for allowing flow of the compressible fluid input into each of the four compression chambers 325, 326, 324, and 323, respectively. One-way valve 107 (shown as a single valve in FIGS. 1 and 2) comprises four separate one-way valves 107A, 107B, 107C and 107D for allowing flow of the compressible fluid output out of each of the four compression chambers 325, 326, 324, and 323, respectively. Control valve 156 allows flow of high pressure hydraulic fluid alternately into one of the drive chambers 321 or 322 through hydraulic lines 146A and 146B (shown as 146 in FIG. 1), respectively, from hydraulic supply line 113, while alternately allowing return of hydraulic fluid from the other of drive chambers 321 or 322 through hydraulic lines 146A and 146B, respectively, to hydraulic return line 114.

Flow of high pressure hydraulic fluid from hydraulic supply line 113 through control valve 156 into drive chamber 321 and return of hydraulic fluid from drive chamber 322 through control valve 156 to hydraulic return line 114 forces the rod 310 and pistons 312, 314, and 316 to move in a first direction thereby increasing the volume of compression chambers 324 and 325 and decreasing the volume of compression chambers 323 and 326. Compressible fluid input is thereby drawn through one-way valves 105A and 105C into compression chambers 325 and 324, respectively, and precompressor output is thereby forced out of compression chambers 326 and 323 through one-way valves 107B and 107D, respectively. Upon reaching the limit of motion in the first direction, magnet 329B in piston 314 is brought near position sensor 126B (shown as 126 in FIG. 1). In a preferred embodiment of the present invention position sensor 126B comprises a magnetic reed switch for sensing when piston 314 is at the end of its motion in the first direction. The signal from position sensor 126B is provided to controller 101, which in turn switches control valve 156, thereby switching flow of high pressure hydraulic fluid from hydraulic supply line 113 from drive chamber 321 to drive chamber 322, and switching return of hydraulic fluid to hydraulic return line 114 from drive chamber 322 to drive chamber 321.

This switching of hydraulic supply and return forces the rod 310 and pistons 312, 314, and 316 to move in a second direction thereby increasing the volume of compression chambers 323 and 326 and decreasing the volume of compression chambers 324 and 325. Compressible fluid input is thereby drawn through one-way valves 105B and 105D into compression chambers 326 and 323, respectively, and precompressor output is thereby forced out of compression chambers 325 and 324 through one-way valves 107A and 107C, respectively. Upon reaching the limit of motion in the second direction, magnet 329A in piston 316 is brought near position sensor 126A (shown as 126 in FIG. 1), comprising a magnetic reed switch in a preferred embodiment of the present invention for sensing when piston 316 is near the end of its motion in the second direction. The signal from position sensor 126A is provided to controller 101, which in switches control valve 156, thereby switching flow of high pressure hydraulic fluid from hydraulic supply line 113 from drive chamber 322 to drive chamber 321, and switching return of hydraulic fluid to hydraulic return line 114 from drive chamber 321 to drive chamber 322. This cycle is repeated until a precompressor output target pressure is detected by pressure sensor 116, whereupon a signal from controller 101 switches control valve 156 thereby blocking flow of high pressure hydraulic fluid from hydraulic supply line 113 to both drive chambers 321 and 322. When the pressure measured by pressure sensor 116 drops below the precompressor output target pressure, the cycle of alternate flow of hydraulic fluid to and from drive chambers 321 and 322 resumes.

In a preferred embodiment of the present invention, center cylinder 302 has a diameter of about three inches and a length of about twelve inches, and each of first and second end cylinders 304 and 306 has a diameter of about eight inches and a length of about twelve inches. Without departing from inventive concepts disclosed and/or claimed herein, any suitable diameters and lengths may be employed for center cylinder 302 and end cylinders 304 and 306, provided that center piston 312 and end pistons 314 and 316 may substantially sealedly reciprocate within center cylinder 302 and end cylinders 314 and 316, respectively.

One or more of pistons 312, 314, and 316 may be provided with one or more piston rings (not shown) for substantially sealedly and reciprocatably engaging the interior of respective cylinders 302, 304, and 306. In a preferred embodiment of the present invention the piston rings may be fabricated from a substantially rigid graphite impregnated polymeric material. Without departing from inventive concepts disclosed and/or claimed herein, any suitable functionally equivalent material may be employed for fabricating the piston rings. One or more of pistons 312, 314, and 316 may be provided with one or more wiper rings (not shown) for substantially sealedly and reciprocatably engaging the interior of respective cylinders 302, 304, and 306. In a preferred embodiment of the present invention the wiper rings may be fabricated from a resilient polymeric material. Without departing from inventive concepts disclosed and/or claimed herein, any suitable functionally equivalent material may be employed for fabricating the wiper rings.

In a preferred embodiment of the present invention, each of the one-way valves comprises a poppet-type check valve comprising a valve body, a valve seat, a valve plunger with a valve head for substantially sealing against the valve seat, and means for urging the valve head against the valve seat. The valve head may be fabricated from a substantially rigid polymeric material for seating against a metal valve seat, thereby providing improved sealing of the one-way valves under the low repetition rate operation of the valves during typical compressor operating conditions. Without departing from inventive concepts disclosed and/or claimed herein, any suitable material or combination of materials may be used to fabricate the valve head and/or the valve seat which provides an adequate seal to allow only substantially one-way flow. Without departing from inventive concepts disclosed and/or claimed herein, any functionally equivalent valve type may be employed which allows only substantially one-way flow.

In alternative embodiments of the present invention, any means for controlling flow may be employed for allowing substantially one-way flow of compressible fluid between various chambers of the hydraulically driven compressor. One-way valves offer the advantage of requiring no additional control mechanism to control flow. Without departing from inventive concepts disclosed and/or claimed herein, one-way flow means may include but are not be limited to: one-way valves; controllable valves which may be opened and closed in response to a control signal; functional equivalents thereof; and combinations thereof.

In a preferred embodiment of the present invention, pressure sensors 116, 118, and 120 comprise diaphragm type pressure gauges, each of which is provided with electrical contacts for providing a signal to controller 101 when the pressure measured by one of the pressure gauges reaches a target pressure for that gauge. One contact may be positioned on the diaphragm of the pressure gauge and the other may be attached to the gauge housing such that the two contacts make contact above a target pressure but do not at lower pressures. The target pressure may be set by the mechanical placement of the electrical contact attached to the gauge housing. Without departing from inventive concepts disclosed and/or claimed herein, any functionally equivalent pressure sensor may be employed which may provide appropriate signals to controller 101 in response to measured pressure.

In alternative embodiments of the present invention, any of a variety of functionally equivalent position sensors for sensing a piston at the end of its motion and capable of providing a signal to the controller may be employed. These may include but are not limited to: magnet/Hall effect sensor combinations; magnet/reed switch combinations; movable electrical contacts; ultrasonic sensors; mechanically actuated switches; functional equivalents thereof; and combinations thereof.

In a preferred embodiment of the present invention, the compressible fluid input to the precompressor may be about ½ to 30 psi, the precompressor output target pressure may be about 150 to 500 psi, the first-cylinder output target pressure may be about 1000–2000 psi, and the second-cylinder output target pressure (equivalently, the compressor output target pressure) may be about 3000–6000 psi. Without departing from inventive concepts disclosed and/or claimed herein, any set of target pressures may be employed in a compressor according to the present invention, and the numbers of precompressor cycles, first cylinder cycles, and second cylinder cycles required for operation of the compressor depend on the relative pressures and volumes for each of the compressible fluid input, precompressor, first cylinder, second cylinder, and compressor fluid output, and may vary widely.

The sequential nature of the precompression and compression stages and cycles described in the preceding paragraphs offer several advantages. In this multiple stage compressor, only one stage is ever operated at one time. This significantly reduces the output power required of the hydraulic power supply, allowing a smaller, less expensive power supply to be employed. Alternatively larger compression rates may be achieved for a given hydraulic output power.

The object of a typical compressor apparatus is to achieve isothermal compression of a compressible fluid. Compression of the fluid results in a significant temperature rise of the fluid being compressed unless the heat generated by the compression can be dissipated efficiently. Heating of the compressible fluid and compressor may lead to vaporization of the hydraulic fluid, thereby contaminating the compressible fluid. In a preferred embodiment of the present invention, multiple precompressor cycles may be required before the precompressor output target pressure is reached, thereby allowing time for the fluid compressed into the first cylinder to cool. Multiple first cylinder cycles may be required before the first-cylinder output target pressure is reached, thereby allowing time for the fluid compressed into the second cylinder to cool. Multiple second cylinder cycles may be required before the second-cylinder output target pressure is reached, thereby allowing time for the high pressure compressible fluid output to cool (for example, in a storage vessel). This allows the compressor to be operated with much lower cooling capacity, or allows operation at higher compression rates for a given cooling capacity.

Another advantage of the multiple stage compressor as set forth herein is the fact that the pressure ratios of the multiple stages may be set in an arbitrary way by simply changing the target pressure set points in the controller and/or pressure sensors. The ultimate pressure achievable is limited only by the maximum pressure available from the hydraulic power supply and the area ratio of the drive and compression chambers of the second cylinder. In a preferred embodiment of the present invention, the maximum available hydraulic pressure is about 4000 psi and the area ratio is about one, but other maximum hydraulic pressures and/or area ratios may be chosen to produce higher output pressures without departing from inventive concepts disclosed and/or claimed herein.

Without departing from inventive concepts disclosed and/or claimed herein, the number and type of precompressor and/or cylinders may be varied in alternative embodiments of the present invention. In an alternative embodiment of the present invention, the precompressor need not comprise a hydraulically driven compressor, but may comprise any functionally equivalent precompressor which may supply the first cylinder stage with a sufficient flow of compressible fluid input at a suitable pressure. In a preferred embodiment of the present invention as shown in FIG. 1, one precompressor stage and two cylinder stages are employed. In cases where the compressible fluid compressor input is available at a high pressure (an industrial gas supply line, for example), the precompressor stage may be omitted in an alternative embodiment of a compressor according to the present invention. In cases where the desired compressor output pressure may be low, the second cylinder stage may be omitted in an alternative embodiment of a compressor according to the present invention. Another alternative embodiment of a compressor according to the present invention may comprise a single cylinder stage only. In cases where exceptionally high compressor output pressures are desired, an alternative embodiment of a compressor according to the present invention may further comprise one or more additional cylinder stages which utilize the compressible fluid output of the second cylinder as a compressible fluid input, and which may further comprise a hydraulic intensifier for raising the pressure of the high pressure hydraulic fluid.

Figure 5:
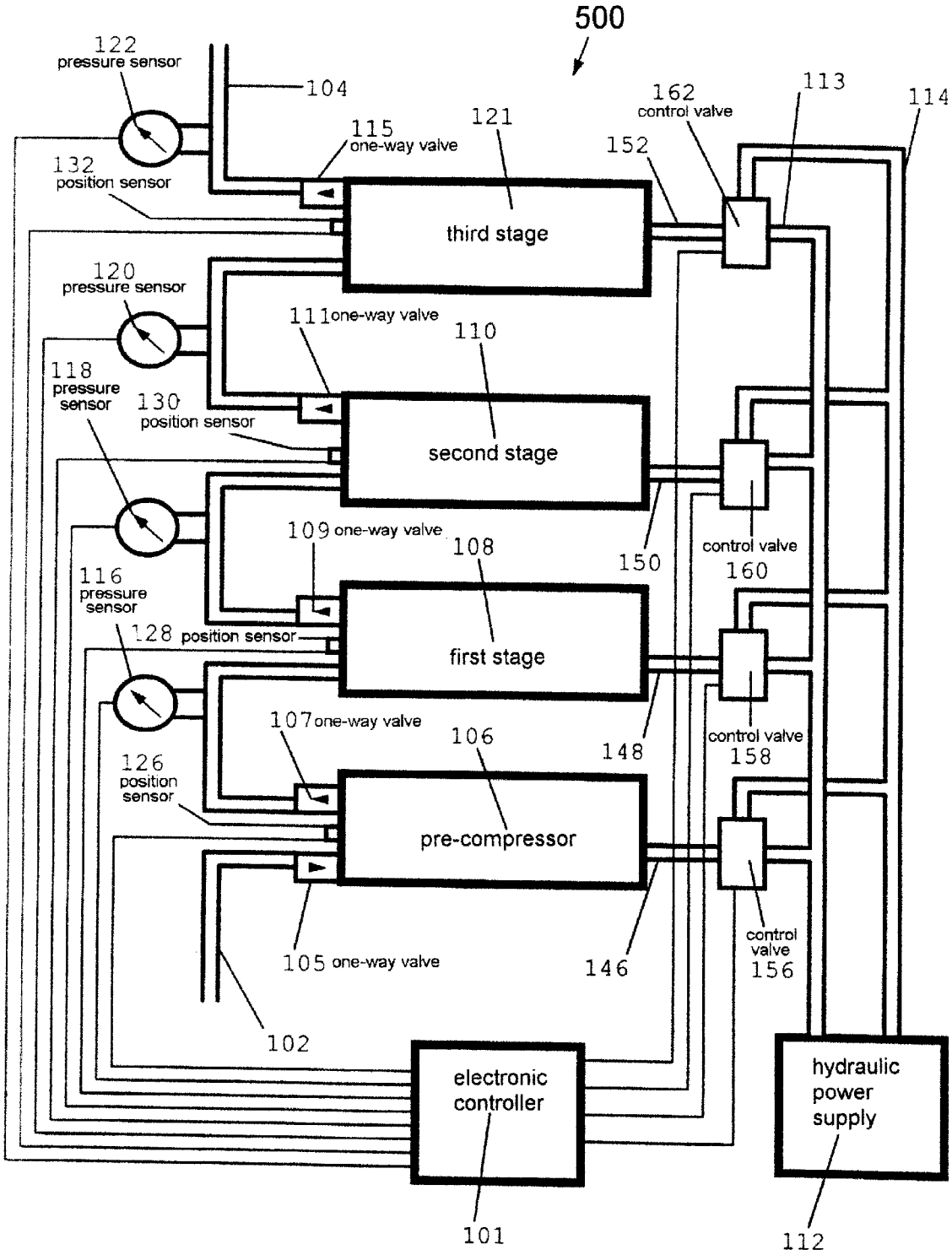
FIG. 5 is a schematic diagram of a hydraulically driven compressor comprising a precompressor, a first cylinder, a second cylinder, a third cylinder, and a hydraulic intensifier according to the present invention.

An alternative embodiment of a compressor 500 according to the present invention is shown in FIG. 5 comprising: a precompressor; first, second, and third cylinders; and a hydraulic intensifier. The structure and operation of precompressor 106, first cylinder 108, and second cylinder 110 are completely analogous to the structure and operation according to the preferred embodiment of the present invention as depicted in FIG. 1. Output from second cylinder 110 flows through one-way valve 111 into third cylinder 121 through operation of precompressor 106, first cylinder 108, and second cylinder 110 until the pressure measured by pressure sensor 120 reaches a second-cylinder output target pressure. During filling of third cylinder 121 hydraulic fluid may flow out of third cylinder 121 through hydraulic line 152 and hydraulic intensifier 162 to hydraulic return line 114. Controller 101 then deactivates precompressor 106, first cylinder 108, and second cylinder 110 (as described hereinabove) and activates third cylinder 121 by activating hydraulic intensifier 162, thereby blocking flow of hydraulic fluid from cylinder 121 to hydraulic return line 114 and producing flow of ultra high pressure hydraulic fluid from hydraulic supply line 113 through hydraulic intensifier 162 into cylinder 121. Compressible fluid is thereby forced to flow out of third cylinder 121 through one-way valve 115 by motion of a free floating piston substantially sealedly and reciprocatably positioned within third cylinder 121, in a manner completely analogous to the operation of first cylinder 108 and second cylinder 110 described hereinabove.

Upon completion of the motion of the piston within third cylinder 121, which is detected by position sensor 132, controller 101 deactivates third cylinder 121 by terminating flow of high pressure hydraulic fluid into cylinder 121, and allowing flow of hydraulic fluid out of third cylinder 121 to hydraulic return line 114. This cycle of operation is repeated until the pressure measured by pressure sensor 122 reaches a third-cylinder output target pressure. Alternative embodiments of third cylinder 121 according to the present invention may comprise any of the alternatives listed hereinabove for the precompressor, first cylinder, and/or second cylinder, or may comprise any combination thereof.

Figure 6:
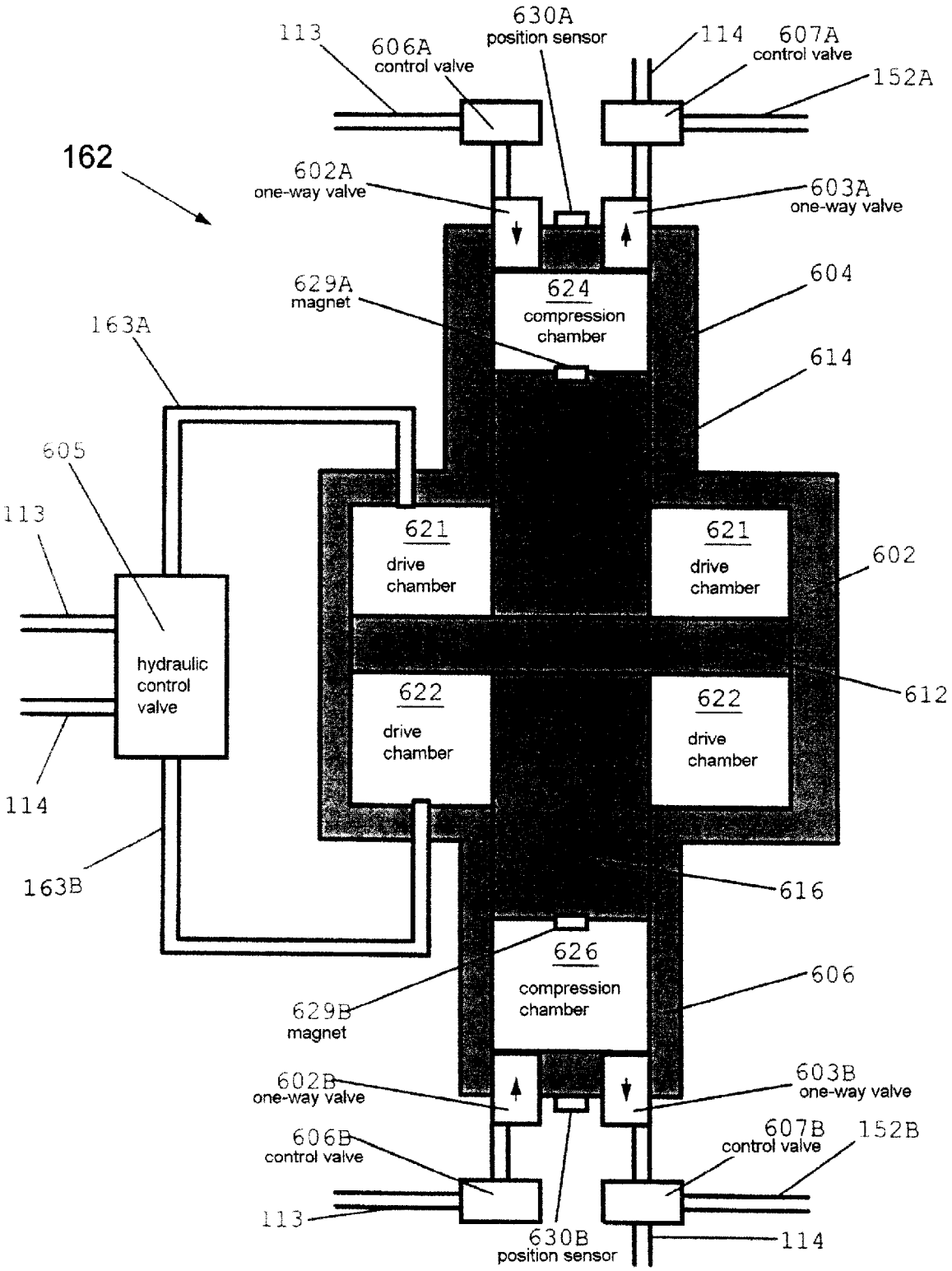
FIG. 6 is a cross sectional view of a hydraulic intensifier of a hydraulically driven compressor according to the present invention.

A preferred embodiment of a hydraulic intensifier 162 is shown in FIG. 6, comprising: a center cylinder 602; a first end cylinder 604 having a diameter smaller than the diameter of center cylinder 602; a second end cylinder 606 having a diameter smaller than the diameter of center cylinder 602; a center piston 612 substantially sealedly and reciprocatably positioned within center cylinder 602 thereby dividing center cylinder 602 into drive chambers 621 and 622; a first end piston 614 connected to center piston 612 and substantially sealedly and reciprocatably positioned within first end cylinder 604, thereby forming compression chamber 624; a second end piston 616 connected to center piston 612 and substantially sealedly and reciprocatably positioned within second end cylinder 606, thereby forming compression chamber 626; one-way valves 602 and 603; hydraulic fluid control valves 605, 606, and 607; and magnets 629 and position sensors 630. During operation of third cylinder 121, high pressure hydraulic fluid flows through hydraulic control valve 605 and hydraulic line 163A into drive chamber 621 and hydraulic fluid may flow out of drive chamber 622 through hydraulic line 163B and hydraulic control valve 605, thereby: forcing ultra high pressure hydraulic fluid out of compression chamber 626 through one-way valve 603B, hydraulic fluid control valve 607B, and into third cylinder 121 through hydraulic line 152B; and drawing high pressure hydraulic fluid from hydraulic supply line 113 through hydraulic fluid control valve 606A, one-way valve 602A, and into compression chamber 624. Sensing of magnet 629B by position sensor 630B results in controller 101 switching control valve 605 thereby allowing flow of high pressure hydraulic fluid from hydraulic supply line 113 through hydraulic fluid line 163B into drive chamber 622 and allowing flow of hydraulic fluid out of drive chamber 621 through hydraulic fluid line 163A to hydraulic return line 114, thereby: forcing ultra high pressure hydraulic fluid out of compression chamber 624 through one-way valve 603A, hydraulic fluid control valve 607A, and into third cylinder 121 through hydraulic line 152A; and drawing high pressure hydraulic fluid from hydraulic supply line 113 through hydraulic fluid control valve 606B, one-way valve 602B, and into compression chamber 626.

The intensifier cycle described in the preceding paragraph is repeated until the pressure measured by pressure sensor 122 reaches a third-cylinder output target pressure, whereupon third cylinder 121 is deactivated by: switching control valve 605 thereby blocking flow of high pressure hydraulic fluid from hydraulic supply line 113 into either of drive chambers 621 or 622; switching control valves 606A and 606B thereby blocking flow of high pressure hydraulic fluid from hydraulic supply line 113 into either of compression chambers 624 or 626; and switching control valves 607A and 607B thereby allowing flow of hydraulic fluid from each of compression chambers 624 and 626 and third cylinder 121 to hydraulic return line 114. Alternative embodiments of intensifier 121 according to the present invention may comprise any of the alternatives listed hereinabove for the precompressor, first cylinder, second cylinder, and/or third cylinder, or may comprise any combination thereof. A significant advantage of the use of a hydraulic intensifier to reach pressures above those available directly from the hydraulic power supply is that the pressure of the compressible fluid in the compression chamber of third cylinder 121 is larger than or substantially equal to the pressure of the hydraulic fluid in the drive chamber of third cylinder 121 (since the areas of the compression chamber and drive chamber are substantially the same), thereby reducing the likelihood of flow of hydraulic fluid from the drive chamber into the compression chamber and contamination of the compressible fluid.

Without departing from inventive concepts disclosed and/or claimed herein, any functionally equivalent type of hydraulic intensifier may be employed in an alternative embodiment of the present invention, provided that said intensifier increases the pressure of the high pressure hydraulic fluid to an adequate level to achieve the desired compression.

In alternative embodiments of the present invention, any of a variety of functionally equivalent means for cooling the compressor may be employed. Without departing from inventive concepts disclosed and/or claimed herein, these may include but are not limited to: immersion of the compressor or parts thereof in a cooling bath; recirculation of a cooling bath; circulation of coolant around and/or within various parts of the compressor; circulation of coolant through a heat exchanger; radiative cooling of coolant and/or heat exchanger; radiative air cooling of the compressor, coolant, and/or heat exchanger; combinations thereof; and functional equivalents thereof.

In a preferred embodiment of the present invention, the controller comprises an analog electronic circuit. In alternative embodiments of the present invention, the controller may comprise any functionally equivalent device for receiving signals from the various pressure and position sensors and in turn generating appropriate control signals for switching hydraulic fluid control valves. Without departing from inventive concepts disclosed and/or claimed herein, these may include but are not limited to: an analog electronic circuit; a digital electronic circuit; a combination analog/digital electronic circuit; an integrated circuit device; a programmable microcontroller; a computer with appropriate control software; a mechanically coupled device; combinations thereof; and functional equivalents thereof.

The present invention has been set forth in the form of its preferred embodiments. It is nevertheless intended that modifications to the disclosed hydraulically driven compressor methods and apparatus may be made without departing from inventive concepts disclosed and/or claimed herein.

What is claimed is:

1. A method for compressing a compressible fluid using an apparatus comprising a precompressor, a first cylinder, a second cylinder, a third cylinder, and a hydraulic intensifier, comprising:

repeating a third-cylinder compression cycle while a pressure measured by a third-cylinder output pressure sensor is smaller than a third-cylinder output target pressure; and terminating said third-cylinder compression cycle when the pressure measured by said third-cylinder output pressure sensor is larger than the third-cylinder output target pressure, wherein said third-cylinder compression cycle comprises:

repeating a second-cylinder compression cycle while a pressure measured by a second-cylinder output pressure sensor is smaller than a second-cylinder output target pressure, thereby filling up a compression chamber of said third cylinder with the compressible fluid through a one-way flow means connecting said second and third cylinders, moving a piston within said third cylinder in a first direction, and forcing hydraulic fluid out of a drive chamber of said third cylinder;

terminating said second-cylinder compression cycle when the pressure measured by said second-cylinder output pressure sensor is larger than the second-cylinder output target pressure; and filling the drive chamber of said third cylinder with high pressure hydraulic fluid from said hydraulic intensifier, thereby moving said piston within said third cylinder in a second direction and forcing the compressible fluid out of said third cylinder through an output one-way flow means, wherein said second-cylinder compression cycle comprises:

repeating a first-cylinder compression cycle while a pressure measured by a first-cylinder output pressure sensor is smaller than a first-cylinder output target pressure, thereby filling up a compression chamber of said second cylinder with the compressible fluid through a one-way flow means connecting said first and second cylinders, moving a piston within said second cylinder in a first direction, and forcing hydraulic fluid out of a drive chamber of said second cylinder;

terminating said first-cylinder compression cycle when the pressure measured by said first-cylinder output pressure sensor is larger than the first-cylinder output target pressure; and filling the drive chamber of said second cylinder with high pressure hydraulic fluid, thereby moving said piston within said second cylinder in a second direction and forcing the compressible fluid out of said second cylinder through the one-way valve connecting said second and third cylinders, wherein said first-cylinder compression cycle comprises:

repeating a precompression cycle while a pressure measured by a precompressor output pressure sensor is smaller than a precompressor output target pressure, thereby filling up a compression chamber of said first cylinder with the compressible fluid through a one-way flow means connecting said precompressor and said first cylinder, moving a piston within said first cylinder in a first direction, and forcing hydraulic fluid out of a drive chamber of said first cylinder;

terminating said precompression cycle when the pressure measured by said precompressor output pressure sensor is larger than the precompressor output target pressure; and filling the drive chamber of said first cylinder with high pressure hydraulic fluid, thereby moving said piston within said first cylinder in a second direction and forcing the compressible fluid out of said first cylinder through the one-way flow means connecting said first and second cylinders, wherein said precompression cycle comprises reciprocation of a first end piston and a second end piston within a first end cylinder and a second end cylinder, respectively, thereby drawing compressible fluid into said precompressor through an input one-way flow means and filling said compression chamber of said first cylinder with compressible fluid through the one-way flow means connecting said precompressor and said first cylinder.

2. A method for compressing as recited in claim 1, wherein:

a first-cylinder position sensor senses said piston within said first cylinder at the point where the motion of said piston in the second direction within said first cylinder has reduced the volume of said compression chamber of said first cylinder to its minimum volume and switches at least one hydraulic fluid control valve, thereby: blocking flow of high pressure hydraulic fluid into said drive chamber of said first cylinder, thereby terminating motion of said piston in the second direction within said first cylinder; and allowing flow of hydraulic fluid out of said drive chamber of said first cylinder, thereby allowing motion of said piston in the first direction within said first cylinder;

a second-cylinder position sensor senses said piston within said second cylinder at the point where the motion of said piston in the second direction within said second cylinder has reduced the volume of said compression chamber of said second cylinder to its minimum volume and switches at least one hydraulic fluid control valve, thereby: blocking flow of high pressure hydraulic fluid into said drive chamber of said second cylinder, thereby terminating motion of said piston in the second direction within said second cylinder; and allowing flow of hydraulic fluid out of said drive chamber of said second cylinder, thereby allowing motion of said piston in the first direction within said second cylinder; and a third-cylinder position sensor senses said piston within said third cylinder at the point where the motion of said piston in the second direction within said third cylinder has reduced the volume of said compression chamber of said third cylinder to its minimum volume and switches said hydraulic intensifier, thereby: terminating flow of high pressure hydraulic fluid into said drive chamber of said third cylinder, thereby terminating motion of said piston in the second direction within said third cylinder; and allowing flow of hydraulic fluid out of said drive chamber of said third cylinder, thereby allowing motion of said piston in the first direction within said third cylinder;

a first precompressor position sensor senses said first end piston within said first end cylinder at the point where said first end piston is substantially against a first bulkhead and switches at least one hydraulic fluid control valve, thereby: blocking flow of high pressure hydraulic fluid into a first drive chamber of a center cylinder of said precompressor and flow of hydraulic fluid out of a second drive chamber of said center cylinder, thereby terminating motion of said first end piston and said second end piston within said first end cylinder and said second end cylinder, respectively, in a first direction; and allowing flow of hydraulic fluid out of said first drive chamber of said center cylinder and flow of high pressure hydraulic fluid into said second drive chamber of said center cylinder, thereby producing motion of said first end piston and said second end piston within said first end cylinder and said second end cylinder, respectively, in a second direction; and a second precompressor position sensor senses said second end piston within said second end cylinder at the point where said second end piston is substantially against a second bulkhead and switches at least one hydraulic fluid control valve, thereby: blocking flow of high pressure hydraulic fluid into said second drive chamber of said center cylinder and flow of hydraulic fluid out of said first drive chamber of said center cylinder, thereby terminating the motion of said first end piston and said second end piston within said first end cylinder and said second end cylinder, respectively, in the second direction; and allowing flow of hydraulic fluid out of said second drive chamber of said center cylinder and flow of high pressure hydraulic fluid into said first drive chamber of said center cylinder, thereby producing motion of said first end piston and said second end piston within said first end cylinder and said second end cylinder, respectively, in the first direction.

3. A method for compressing as recited in claim 2, wherein:

each of said position sensors comprises a magnet mounted on said respective piston within said respective cylinder and a magnetically actuated reed switch mounted on said respective cylinder;

each of said pistons is provided with at least one piston ring for substantially sealedly and reciprocatably engaging said respective cylinder of each of said pistons, and each of said piston rings is fabricated from a substantially rigid graphite impregnated polymeric material;

each of said pistons is provided with at least one wiper ring for substantially sealedly and reciprocatably engaging said respective cylinder of each of said pistons, and each of said wiper rings is fabricated from a resilient polymeric material;

each of said one-way flow means comprises a poppet-type check valve comprising a valve head fabricated from a substantially rigid polymeric material for seating against a metal valve seat; and said compressor is immersed in a coolant bath and heat is removed from said compressor by circulation of said coolant bath through a radiatively cooled heat exchanger.

* * * * *